United States Patent [19]

Schirmer

[11] Patent Number: 4,483,832

[45] Date of Patent: Nov. 20, 1984

[54] RECOVERY OF HEAT VALUES FROM VITIATED GASEOUS MIXTURES

[75] Inventor: Robert M. Schirmer, Bartlesville, Okla.

[73] Assignee: Phillips Petroleum Company, Bartlesville, Okla.

[21] Appl. No.: 363,680

[22] Filed: Mar. 30, 1982

[51] Int. Cl.[3] ..... B01D 53/34

[52] U.S. Cl. ..... 423/210; 422/183; 431/5; 431/9; 431/10; 431/116

[58] Field of Search ..... 423/210 C, 245, 246; 431/9, 115, 116, 5, 10; 422/182, 183

[56] References Cited

U.S. PATENT DOCUMENTS 3,637,343 1/1972 Hirt ..... 423/210 C 3,993,449 11/1976 Childs ..... 431/9 X 4,073,871 2/1978 Optiz et al. ..... 423/210 X 4,154,567 5/1979 Dahmen ..... 431/9 X

*Primary Examiner*—Earl C. Thomas

[57] ABSTRACT

The present invention relates to the recovery of heat values, including sensible heat and/or combustion heat, from vitiated gaseous mixtures containing oxygen and/or combustibles together with inert diluents in which a supplemental fuel is burned, in a combustion zone or the first stage of a two-stage, rich-lean combustion zone, the vitiated gaseous mixture is mixed with the combustion products at the downstream end of the combustion zone or the first stage of the two-stage combustion zone, as the case may be, and the effluent of the combustion is passed to a heat utiization zone.

32 Claims, 6 Drawing Figures

RECOVERY OF HEAT VALUES FROM VITIATED GASEOUS MIXTURES

BACKGROUND OF THE INVENTION

The present invention relates to a method of recovering heat values from vitiated gaseous mixtures. More specifically, the present invention relates to a method of burning a supplemental fuel and simultaneously recovering heat values from vitiated gaseous mixtures, including sensible heat and the heat of combustion of any combustibles in the vitiated gaseous mixture.

Numerous manufacturing operations produce large quantities of hot, vitiated gaseous mixtures containing significant amounts of oxygen, combustibles, such as carbon monoxide, unburned fuels and carbon, or both oxygen and combustibles together with inert diluents. In addition, many of such manufacturing operations also require substantial amounts of fuel for process heating, the production of steam, etc. When fuels are relatively abundant and prices relatively low, it was common practice to vent the vitiated gaseous mixtures. This practice obviously wasted the sensible heat of such vitiated gaseous mixtures as well as the heat values which could be recovered by burning the combustibles. In addition, to the extent that the vitiated gaseous mixtures contained significant amounts of combustibles, such venting also contributed significantly to air pollution. Accordingly, with diminished supplies of fuels, particularly petroleum based fuels, and the substantial increases in the cost of fuels, it is no longer economic to waste the heat values of such vitiated gaseous mixtures. Accordingly, it has been proposed that the heat values of vitiated gaseous mixtures be recovered by combining the vitiated gaseous mixture with a supplemental fuel and supplemental air and burning the mixture to produce heat for process heaters, steam boilers and the like. However, irrespective of the amounts of supplemental fuel and supplemental air added to certain vitiated gaseous mixtures, there are certain such mixtures which are below the flammability threshold and, therefore, will not burn and others which are above the flammability threshold and theoretically should burn, but are incapable of stable combustion and sustained combustion, i.e., are subject to flame-out. In addition, such suggested techniques themselves produce significant amounts of air pollutants, including $NO_x$, CO, carbon, unburned fuels, etc. In fact, in many cases, the method utilized to recover the heat values from the vitiated gaseous mixtures is equally as inefficient as the processes which produced the vitiated gaseous mixtures.

SUMMARY OF THE INVENTION

It is, therefore, an object of the present invention to provide an improved method of recovering heat values from vitiated gaseous mixtures which overcomes the above-mentioned and other problems of the prior art. A further object of the present invention is to provide an improved method of recovering heat values from vitiated gaseous mixtures in which stable, sustained combustion is maintained. Yet another object of the present invention is to provide an improved method of recovering heat values from vitiated gaseous mixtures which produces substantially reduced amounts of air pollutants. Another and further object of the present invention is to provide an improved method of recovering heat values from vitiated gaseous mixtures in which stable, sustained combustion is maintained and, simultaneously, the amount of air pollutants produced is substantially reduced. Yet another object of the present invention is to provide an improved method of recovering sensible heat from hot vitiated gaseous mixtures. A further object of the present invention is to provide an improved method of recovering sensible heat from hot vitiated gaseous mixtures, while simultaneously reducing the amount of air pollutants produced. Another object of the present invention is to provide an improved method of recovering heat values from vitiated gaseous mixtures, containing significant amounts of combustibles, in which the combustibles are burned to produce additional heat. Another and further object of the present invention is to provide an improved method of recovering heat values from hot vitiated air mixtures, containing significant amounts of combustibles, in which both the sensible heat of the vitiated gaseous mixture, as well as heat produced by burning the combustibles are recovered. These and other objects and advantages of the present invention will be apparent from the following description.

In accordance with the present invention, heat values are recovered from a vitiated gaseous mixture, containing significant amounts of oxygen and/or combustibles together with inert diluents, which, in combination with a supplemental fuel and/or supplemental air, is incapable of stable, sustained combustion at a temperature at which the supplemental fuel is in its gaseous state, in which a supplemental fuel in burned in the presence of air in a combustion zone to produce combustion products at the downstream end of the combustion zone; the vitiated gaseous mixture is mixed with the combustion products adjacent the downstream end of the combustion zone and the thus produced mixture of the vitiated gaseous mixture and the combustion products is passed to a heat utilization zone. In a preferred embodiment, the amount of air utilized to burn the supplemental fuel is less than the stoichiometric amount necessary to burn all of the supplemental fuel and a second volume of air is added to the combustion products from the burning of the supplemental fuel adjacent the point at which the vitiated gaseous mixture is mixed with the combustion products, in an amount such that the total oxygen from the first volume of air, the second volume of air and any oxygen present in a vitiated gaseous mixture is at least equal to the stoichiometric amount necessary for combustion of all of the supplemental fuel and the combustibles of the vitiated gaseous mixture, if present.

DESCRIPTION OF THE PREFERRED EMBODIMENTS

While the following description, for convenience and clarity, illustrates the present invention by reference to a particular vitiated gaseous mixture, it is to be understood that such reference is not to be considered limiting and that the present invention is applicable to many other vitiated gaseous mixtures having substantially different components and contents of components.

As pointed out in the introductory portion hereof, there are many vitiated gaseous mixtures produced in industrial operations. By way of specific example, in the cracking of hydrocarbon oils to produce lighter hydrocarbon fractions, the catalyst collects carbon and it is necessary to regenerate the catalyst by burning off the carbon in the presence of oxygen. Such a regeneration operation produces a hot vitiated gaseous mixture containing from about 5 to 15% by volume of oxygen, 0.5 to 10% by volume or higher of carbon monoxide and the balance inert diluents, principally nitrogen and carbon dioxide. It has been proposed that the carbon monoxide can be burned to recover heat values therefrom and the heat values of the hot vitiated gaseous mixture can also be recovered by combining the vitiated gaseous mixture with a supplemental fuel and supplemental air. At first blush, this process would appear to be an excellent means to recover such heat values and utilize the same for other process heating, such as the heating of the hydrocarbon oils to the catalytic cracker, the generation of plant steam, etc. Another apparent advantage is that many process heaters, boilers and the like operate most efficiently if the air to the combustion zone is preheated and, in such cases, such preheating of the air can be eliminated or at least reduced by mixing the hot vitiated gaseous mixture with the air to the burner. However, the process is not as simple and straightforward as it appears and numerous problems exist.

The problems associated with simply combining vitiated gaseous mixtures with supplemental fuel and supplemental air and burning the thus produced mixture to recover heat values from the vitiated gaseous mixture is best illustrated by specific reference to the use of a vitiated gaseous mixture, produced in the regeneration of a catalytic cracking catalyst, in which the vitiated gaseous mixture contains between about 5% and 15% by volume of oxygen, about 0.5% to 1.5% by volume of carbon monoxide and the balance nitrogen and carbon dioxide. In the exemplified system, this gas is produced in volumes from about 14,000 to 18,333 standard cubic feet per minute and is at a temperature between about 695° and 1117° F.

Figure 1:
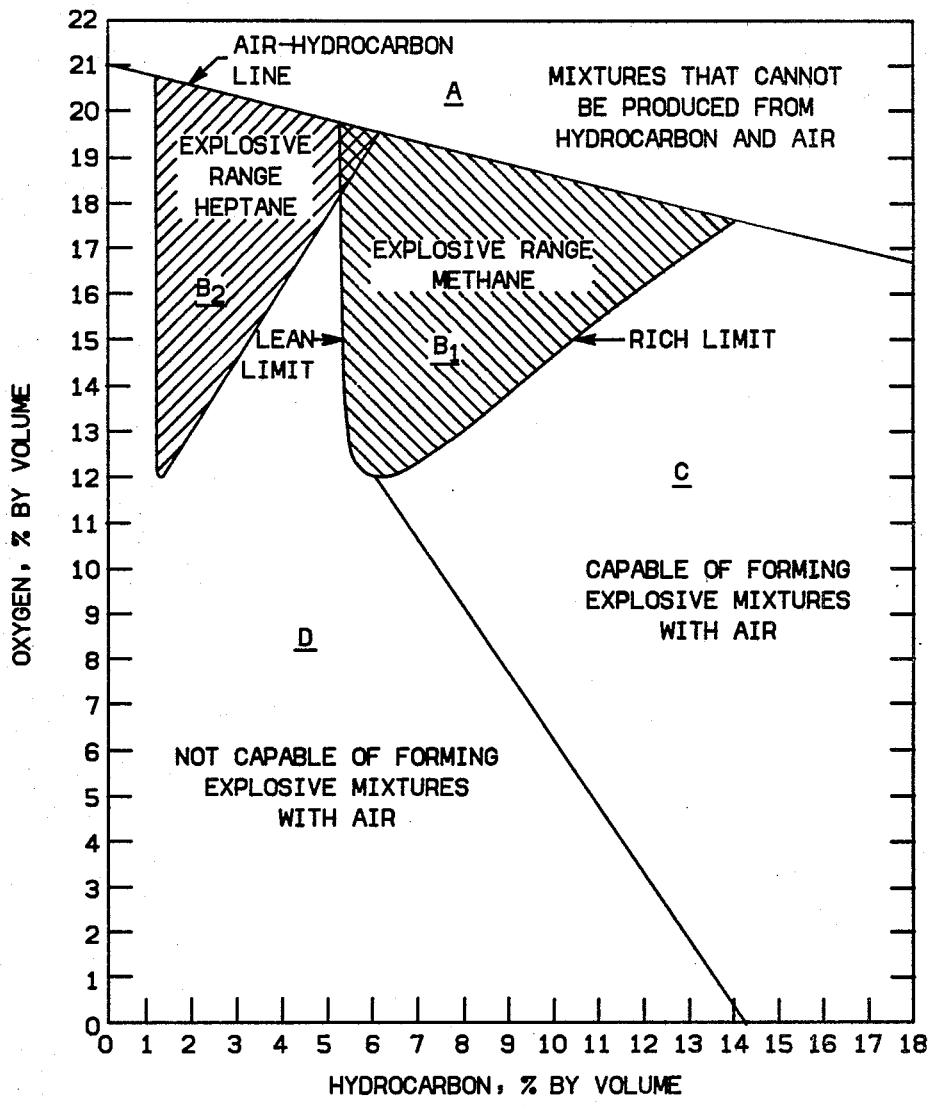
FIG. 1 of the drawings is a plot of flammability limits of homogeneous mixtures of hydrocarbons, air and nitrogen.

FIG. 1 of the drawings illustrates the flammability limits of homogeneous mixtures of supplemental natural gas, supplemental air and the previously mentioned vitiated gaseous mixture. Since natural gas is principally methane and the inert diluents of the vitiated gaseous mixture is principally nitrogen, for illustrative purposes methane is used as a supplemental fuel and nitrogen as the diluent. It is to be observed from the plot of FIG. 1, which shows percent by volume of oxygen versus percent by volume of hydrocarbon, that there is an area A of the plot covering mixtures that cannot be produced from a hydrocarbon and air. This, of course, results from the fact that there are fixed amounts of oxygen in air. There is also an envelope or area B1 which includes mixtures in the explosive range. This area is limited by the lean mixture limit, i.e., fuel lean, and the rich mixture limit, i.e., fuel rich. Mixtures in this area are thus readily combustible. The mixtures falling within area C of the plot are capable of forming explosive mixtures by the addition of appropriate amounts of air and, as such, are then theoretically combustible. However, mixtures within the area D are not capable of forming explosive mixtures with any amount of air. In addition, it should also be noted that below 12% by volume of oxygen, no mixture of a hydrocarbon fuel, air and nitrogen is flamable per se at ambient temperature. Thus, it is obvious that there is only a very limited combination of methane, air and nitrogen (inert diluents of the vitiated gaseous mixture) which can be burned by the addition of supplemental methane and supplemental air to recover the heat values from the vitiated gaseous mixture. Comparatively, there are extremely broad areas of mixtures which cannot be utilized in such a direct process. Obviously, similar relationships exist for other hydrocarbons than methane. This is illustrated by the area B2 which envelopes the explosive range for heptane. Likewise, these same relationships exist for vaporized, normally liquid fuels and the vaporized combustibles of normally solid fuels.

Figure 2:
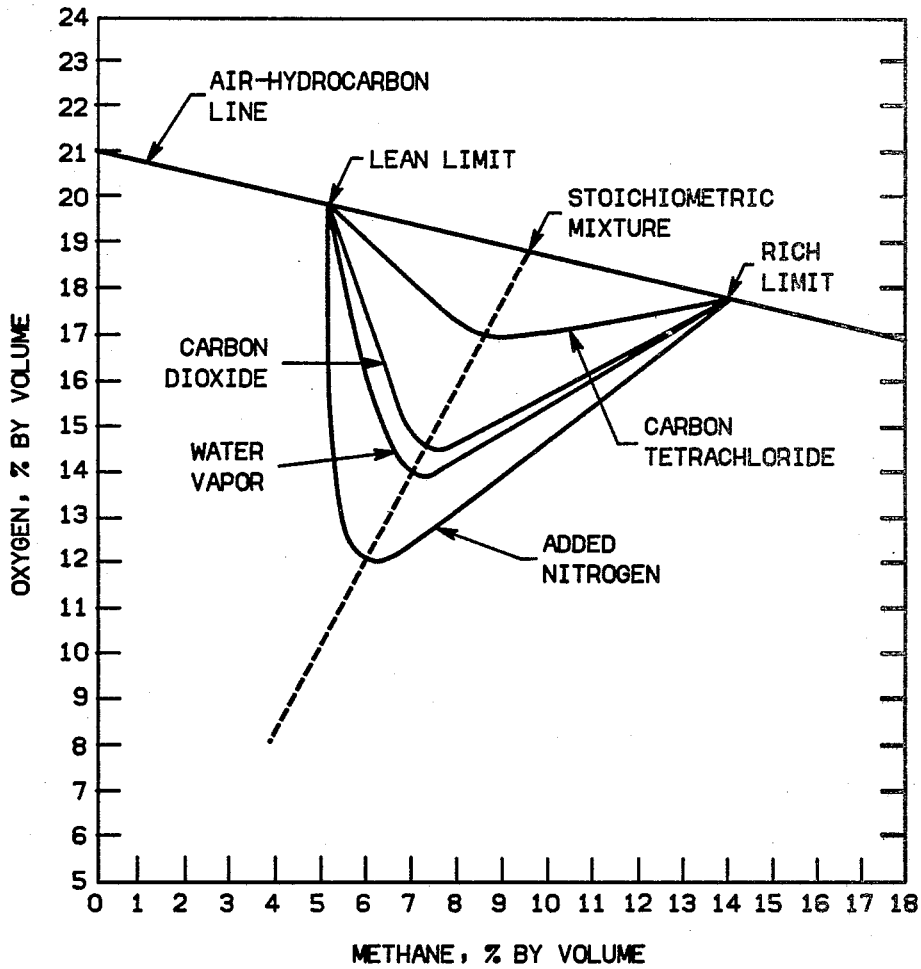
FIG. 2 is a plot of flammability limits of methane in air mixed with various diluents.

Obviously, the flammability limits of fuel, air and vitiated gaseous mixtures, containing inert diluents other than nitrogen, will have different flammability limits. This is illustrated by FIG. 2 of the drawings, which is a plot of percent by volume of methane versus percent by volume of oxygen, for mixtures of methane in air with other diluents. FIG. 2 shows the explosive range for water vapor, carbon dioxide and carbon tetrachloride in addition to that for nitrogen.

Figure 3:
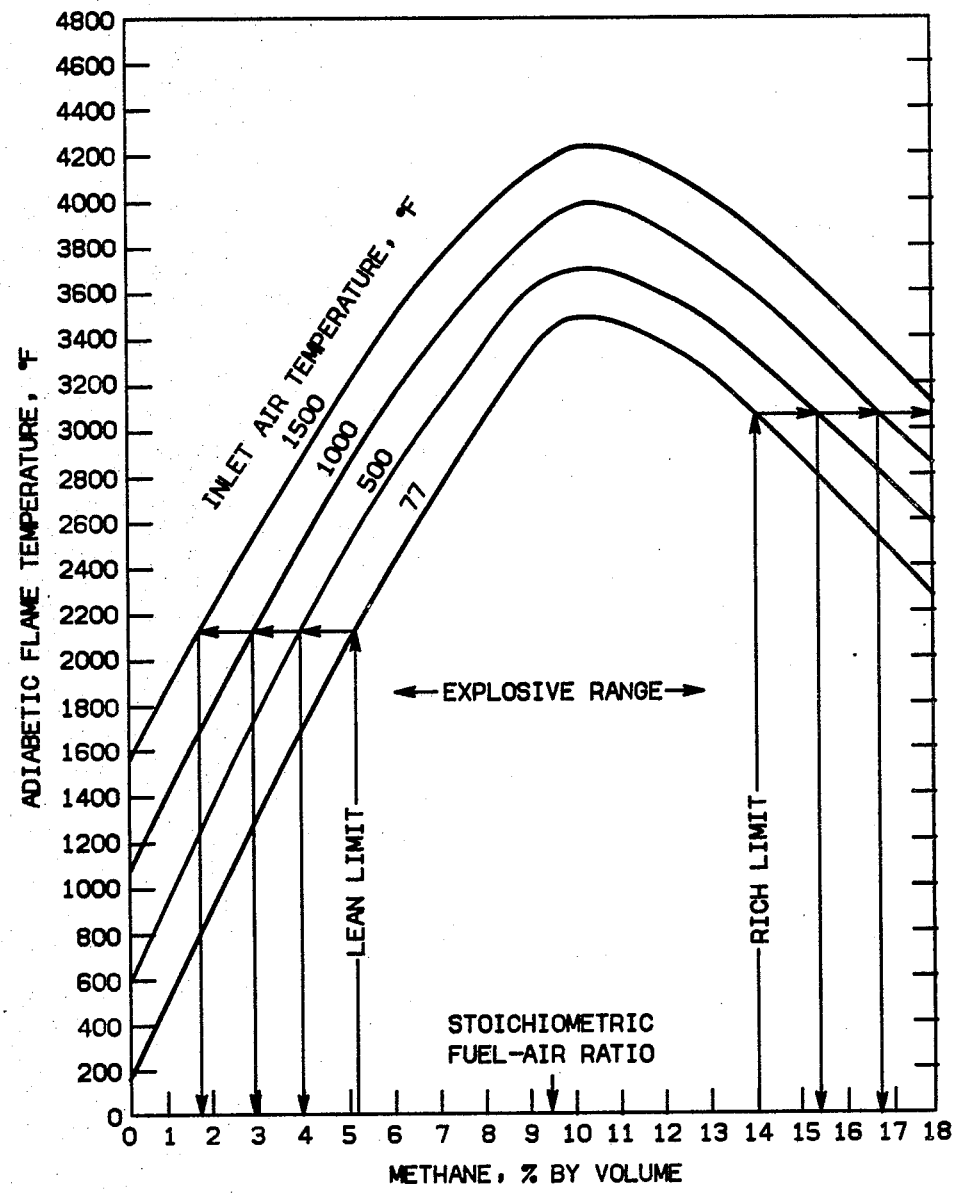
FIG. 3 is a plot of the flammability limits of methane in air mixtures at various preheat temperatures.
Figure 4:
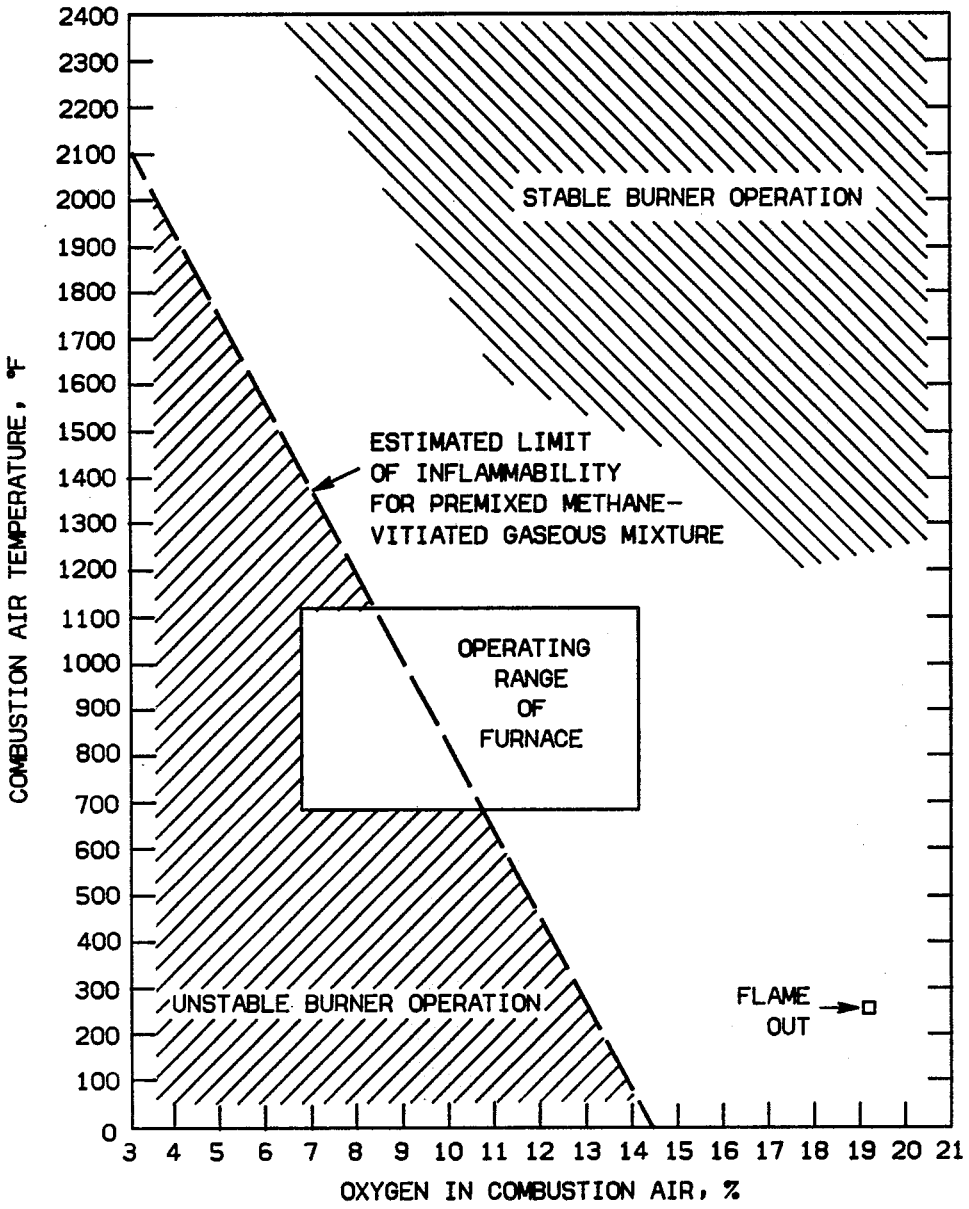
FIG. 4 is a plot of operating conditions and stability limits for a specific burner.

The plots of FIGS. 1 and 2 cover mixtures in which the air is at ambient temperature. Obviously, the flammability limits can be changed by preheating the air. This is illustrated by FIG. 3 of the drawings, in which percent by volume of methane is plotted against adiabatic flame temperature in degrees F. The explosive range for methane and air at various air preheat temperatures is shown. This explosive range at 77°, or ambient temperature, is the area beneath the lowermost curve and between the lean limit to the left and the rich limit to the right. Similarly, at 500° preheat, the explosive range is the area under the 500° F. curve and between the vertical line, which intercepts the 500° F. curve, representing the lean limit, and the vertical line to the right, which intercepts the 500° curve, representing the rich limit. It is obvious from FIG. 3, that as the preheat temperature of the air is increased, the areas of mixtures of fuels and air which are within the explosive range increase. In addition to the problems and limitations associated with burning homogeneous mixtures of a fuel, air and a vitiated gaseous mixture, illustrated by the discussion of FIG. 1, it has been found, in accordance with the present invention, that such mixtures, which should theoretically burn, do not, in fact, burn effectively and efficiently. FIG. 4 of the drawings illustrates a specific example in which an effort was made to burn the previously mentioned catalyst regeneration gas by combining the same with ambient air and natural gas in a conventional furnace. As previously pointed out, the catalyst regeneration gas contained about 5% to 13% oxygen and was at a temperature of about 800° to 1250° F. and was produced in amounts between about 14,000 and 18,333 standard cubic feet per minute. 2300 standard cubic feet per minute of this vitiated gaseous mixture was blended with ambient air and fed to the furnace where it was the sole source of oxygen for the burners. Natural gas was utilized as a supplemental fuel. It was calculated that the oxygen content of the mixture was between about 6.8% and 14.1% by volume and the temperature between about 695° and 117° F. This operating range of the furnace is illustrated by the block of FIG. 4. As previously pointed out, the flammability limit dividing areas C and D of FIG. 1 changes as the temperature of the mixture changes. Accordingly, the estimated limit of inflammability for premixed methane, the vitiated gas mixture and oxygen was calculated and is shown as the diagonal dashed line of FIG. 4. It is to be noted that nearly half of the operating range of the furnace is below the threshold of inflammability. Hence, it would require a theoretically perfect burner to operate over the range of conditions for burning the mixture indicated. Obviously, it is not possible to design such a theoretically perfect burner, nor is it possible to operate at all times at optimum conditions. However, an effort was made to provide a mixture of about 78% ambient air with supplemental natural gas and the vitiated gaseous mixture containing 13% oxygen and having a temperature of 915° F. in the subject furnace. It was calculated that the oxygen for combustion in the furnace would be about 19.2% and the temperature about 268° F. This point is shown on FIG. 4. It can be seen that this operating point is a significant distance to the right of the limit of inflammability line and, therefore, effective combustion should have been possible. However, serious problems of combustion instability and flame-out were encountered.

It has been found, in accordance with the present invention, that heat values can be recovered from any vitiated gaseous mixture containing significant amounts of oxygen and/or combustibles utilizing any convenient supplemental fuel while maintaining stable, sustained combustion. In addition, in accordance with the present invention, the volume of air pollutants produced by burning any convenient fuel as a supplemental fuel, including normally gaseous fuels, from light to extremely heavy liquid fuels, normally solid fuels, and such fuels containing substantial amounts of chemically bound nitrogen, can be reduced.

Figure 5:
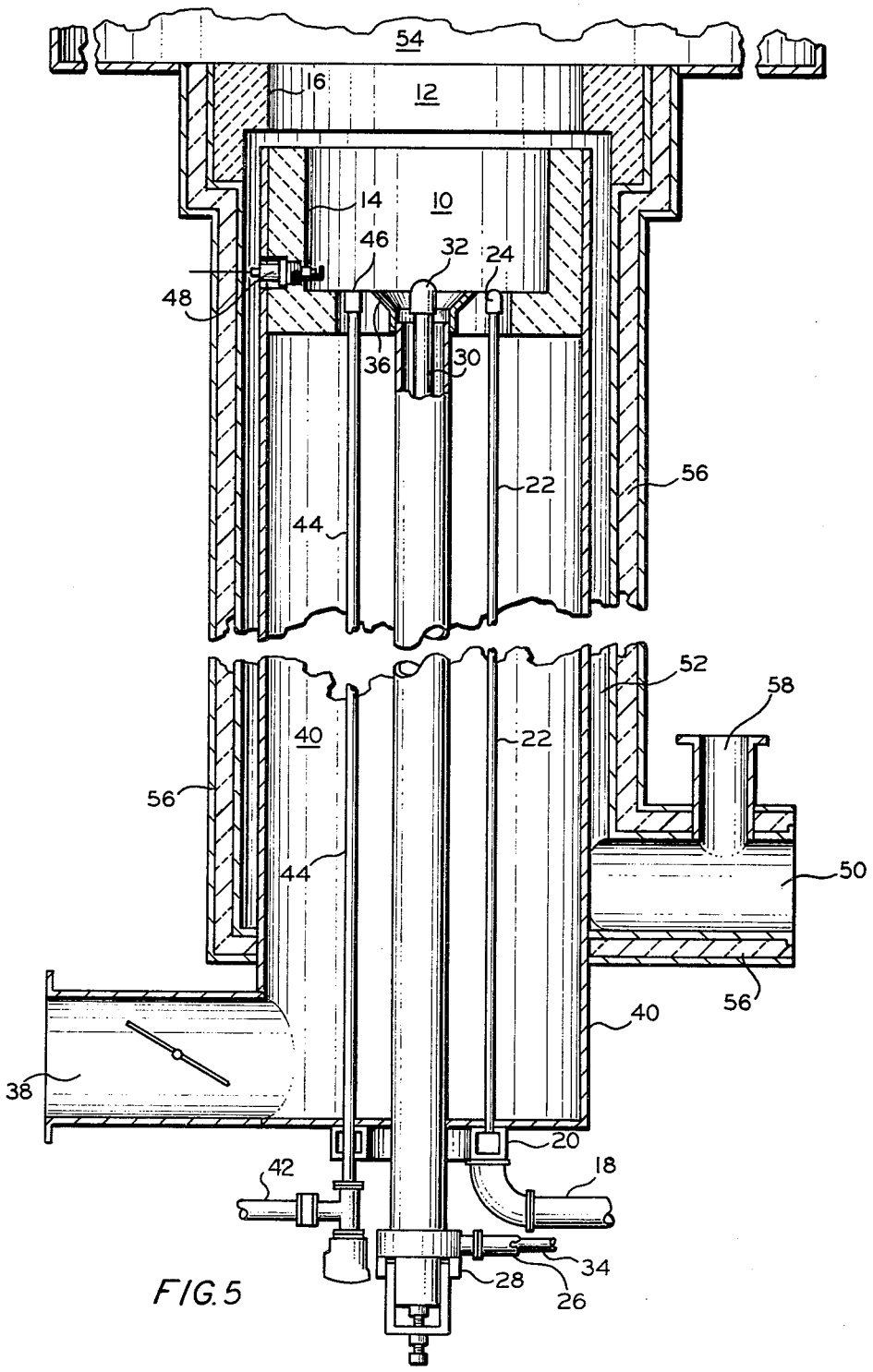
FIG. 5 is an elevational view, partially in section, of a burner suitable for practicing the method of the present invention.

FIG. 5 of the drawings is a simplified illustration of a burner which has been constructed and successfully operated in accordance with the present invention. In FIG. 5, the numeral 10 refers to a combustion chamber. In those instances, in accordance with the present invention, where a single volume of supplemental air is utilized, combustion zone 10 is the sole combustion zone, whereas, in those instances in which the vitiated gaseous mixture contains combustibles and/or only partial combustion of the supplemental fuel occurs in combustion zone 10, a second combustion zone 12 is provided downstream from and in open communication with combustion zone 10. Combustion zones 10 and 12 are preferably lined with ceramic or other heat resistant linings, 14 and 16, respectively. The burner illustrated in FIG. 5 is constructed to operate on either a normally gaseous supplemental fuel or a normally liquid supplemental fuel. Specifically, a normally gaseous fuel can be supplied through line 18 to an annular plennum chamber 20, thence through tube 22 to gas burner tip 24. In the specific instance being illustrated, plennum chamber 20 has 8 tubes 22 and burner tips 24 in communication therewith and formed in a circle. A normally liquid supplemental fuel is supplied through supply line 26 to an oil body assembly 28, thence through oil tube 30, which terminates in an appropriate spray atomizer tip 32. The liquid fuel atomizer or spray is preferably steam-assisted by steam supplied through line 34. Obviously, an air-assist nozzle could also be utilized. In order to aid in directing the spray of liquid fuel into combustion zone 10, a cone element 36 surrounds tip 32. Air for the combustion of the supplemental fuel is supplied through air duct 38, air register 40 and thence as an annular stream into combustion zone 10. Where the supplemental fuel is other than a normally gaseous fuel, such as natural gas, combustion can be initiated in combustion zone 10 by supplying a pilot fuel, such as propane, from supply line 42 through tube 44 and thence to a propane torch 46 located adjacent the upstream end of combustion zone 10. Ignition may be carried out by a conventional spark plug 48 or other appropriate electrical ignition means. Where the supplemental fuel is natural gas or the like, the propane torch is not necessary and combustion can be initiated by spark plug 48. The vitiated gaseous mixture is introduced through duct 50 into annular chamber 52 and thence, in accordance with the present invention, into the flue gas or combustion products adjacent the downstream end of combustion zone 10. The effluent gases are then passed to an appropriate heat utilization zone 54, which may be a process heater, a furnace, a boiler to produce steam, etc. In order to preserve the heat value of the sensible heat of the vitiated gaseous mixture, where such mixture is above ambient temperature, suitable insulation 56 is provided around duct 50, the annular vitiated gaseous mixture chamber 52 and the burner proper.

The apparatus, as described up to this point, will be operated, in accordance with the present invention, by introducing sufficient air through duct 38 to provide at least a stoichiometric amount of oxygen necessary for combustion of all the combustibles present in the supplemental fuel and the vitiated gaseous mixture. To assure essentially complete combustion of the combustibles, the amount of air introduced in this instance is about 2% to 3% in excess of the stoichiometric amount. If the vitiated gaseous mixture introduced through duct 50 contains significant amounts of combustibles from which heat values may be recovered, the amount of air introduced through line 38 is an amount at least equal to the stoichiometric amount of oxygen necessary to burn all of the supplemental fuel plus the combustibles in the vitiated gaseous mixture. In addition, the second combustible zone 12 would be necessary in order to burn the combustibles present in the vitiated gaseous mixture. Alternatively, the combustion zone 12 can be eliminated and combustion completed in the heat utilization zone 54. In the apparatus shown, it is to be noted that combustion products at the downstream end of combustion zone 10 are abruptly expanded into combustion zone 12. This abrupt expansion causes reverse circulation to the periphery of combustion zone 12, which, among other things, aids in mixing the combustion products from combustion zone 10 with the vitiated gaseous mixture and reduces feed back of gases from combustion zone 12 to combustion zone 10, thereby, in some cases, avoiding premature quenching of the combustion in combustion zone 10. This mixing and prevention of premature quenching is further aided by introducing the vitiated gaseous mixture radially into the combustion products at the downstream end of combustion zone 10. Obviously, such abrupt expansion could be directly into the heat utilization zone 54. The abrupt expansion into combustion zone 12 can be at an angle other than a 90° angle with respect to the wall of combustion chamber 12. Specifically, to attain the advantages of this abrupt expansion, the angle of expansion, with respect to the wall of combustion zone 12, should be greater than 15°, since, at 15° or less, streamlined flow will occur.

In accordance with the preferred embodiment of the present invention, air through duct 38 is introduced as a first volume of air and in an amount less than the stoichiometric amount necessary for combustion of all of the supplemental fuel. A second volume of air is then introduced through duct 58, where it is mixed with the vitiated gaseous mixture and introduced into the combustion products at the downstream end of combustion zone 10 along with the vitiated gaseous mixture. Obviously, the second volume of air and the vitiated gaseous mixture could be introduced separately, provided only that they are introduced into the combustion products from combustion zone 10 at the downstream end of combustion zone 10. In this mode of operation, the second volume of air is an amount sufficient to provide a total of oxygen from the first volume of air, oxygen from the second volume of air and oxygen from the vitiated gaseous mixture, if significant amounts are present, which is at least equal to the stoichiometric amount necessary for combustion of all of the supplemental fuel plus any combustibles present in the vitiated gaseous mixture. As previously indicated, the first volume of air introduced through duct 38 is less than the stoichiometric amount necessary for combustion of all of the supplemental fuel. Accordingly, the combustion products or flue gases at the downstream end of combustion zone 10 will contain small amounts of unburned fuels and partially burned fuels. Combustion of these unburned and partially burned fuels, present in the combustion products at the downstream end of combustion zone 10, as well as any combustibles present in the vitiated gaseous mixture, is therefore completed in the second combustion zone 12 and/or the heat utilization zone 54. By selecting appropriate supplemental fuel-first volume of air ratios and an appropriate residence time within combustion zone 10 and an appropriate residence time in the second combustion zone 12 and/or 54, this mode of operation results in the production of ultimate flue gases having substantially reduced amounts of pollutants, particularly $NO_x$ pollutants. This is true in all instances, whether $NO_x$ results from thermal $NO_x$ (from the nitrogen in the first volume of air) or $NO_x$ produced from chemically bound nitrogen in the supplemental fuel. In addition, this mode of operation results in substantially complete combustion of all of the combustibles and therefore low CO pollutants and unburned fuel or carbon pollutants. The abrupt termination of combustion at the downstream end of combustion zone 10, caused by the abrupt expansion into the second combustion zone, is a particularly important factor in this two stage, rich-lean type of operation.

Figure 6:
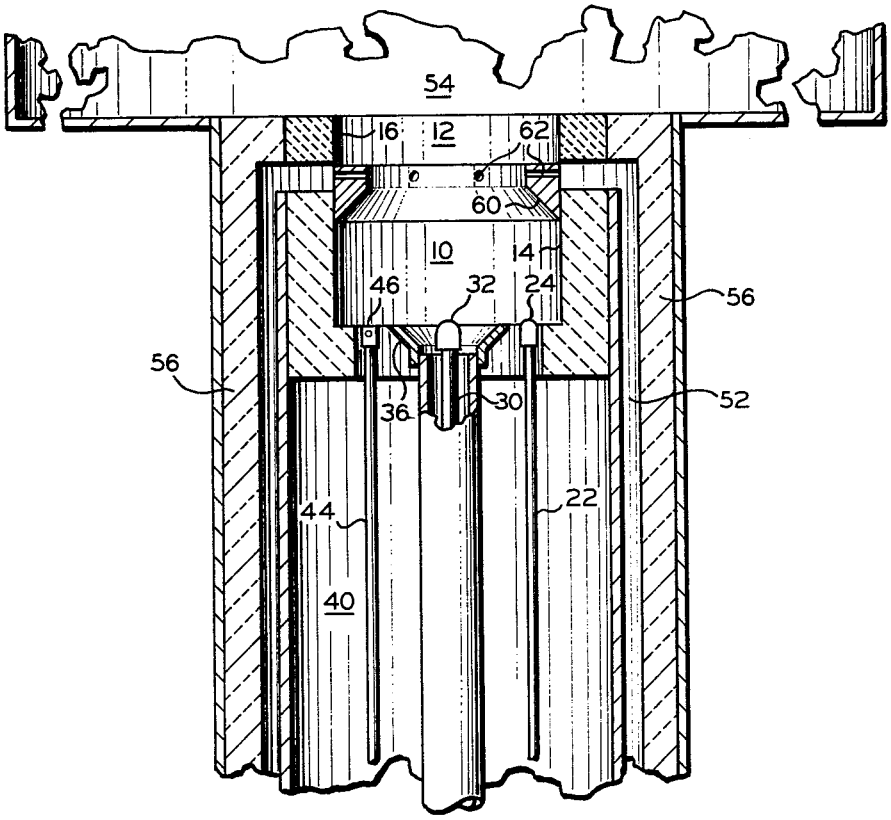
FIG. 6 is an elevational view, partially in section, illustrating a modification of the burner of FIG. 4.

For convenience of comparison, where possible, the elements of FIG. 6, which are equivalent to the elements of FIG. 5, are identified by the same reference numerals.

FIG. 6 of the drawings illustrates a modification of the combustor of FIG. 5, which further aids in the abrupt termination of the combustion at the downstream end of combustion zone 10. Specifically, an orifice or nozzle 60 is formed adjacent the downstream end of combustion zone 10. This orifice or nozzle serves to reduce the peripheral dimensions of the fluids existing from combustion zone 10 and, thereafter, abruptly expands these fluids into the second combustion zone. This restriction is preferably a nozzle, as shown, having a sloping or angular upstream form which prevents the collection of deposits at the upstream side of the restriction means, particularly where heavy supplemental fuels are utilized. The abrupt termination of combustion zone 10 is further aided by introducing the vitiated gaseous mixture and/or the second volume of air from annular chamber 52 through a plurality of aperatures 62. This produces a plurality of radial jets introducing the vitiated gaseous mixture and/or the second volume of air into the combustion products at the downstream end of combustion zone 10. The introduction of the vitiated gaseous mixture and/or the second volume of air can be immediately before the reduction, into the reduced peripheral dimension portion of the fluids or immediately after the reduction, provided only that such introduction be immediately adjacent the reduction in peripheral dimensions.

By way of illustration, typical operating variables for operating in a two stage, rich-lean fashion, in accordance with the present invention, are given hereinafter. Specifically, the fuel-air equivalence ratio in the combustion zone 10 should be between about 1.0 and 1.8. Preferably, for a light fuel with high concentration of nitrogen the equivalence ratio is between about 1.05 and about 1.7 and ideally, about 1.14 to about 1.56. For a heavier oil, such as shale oil, the preferred range is about 1.3 to about 1.7 and ideally about 1.4 to about 1.65. The term "equivalence ratio", as utilized herein, is the ratio of the actual fuel-air mixture to the stoichiometric fuel-air mixture. For example, an equivalence ratio of 1.0 is stoichiometric whereas an equivalence ratio of 1.5 means the fuel-air mixture is fuel-rich and contains 1.5 times as much fuel as the stoichiometric mixture. Sn about 30 milliseconds and about 140 milliseconds. For a light fuel, the preferred range is about 30 to about 120 milliseconds and ideally between about 45 and about 75 milliseconds. For heavy fuels, the preferred range is about 35 to about 140 milliseconds and ideally about 100 to 140 milliseconds. Obviously this means that, for a fixed diameter combustion zone 10, the combustion zone would be relatively short for gaseous supplemental fuels and relatively long for normally liquid and normally solid fuels. The fuel-air equivalence ratio in the second combustion zone 12 and/or 54 should be such as to produce an over all fuel-air equivalence ratio between about 0.50 and 1.0, preferably between about 0.75 and 0.87 and most preferably 0.87. 0.87 represents an excess of 3% oxygen above the stoichiometric amount. The residence time in the second combustion zone should be at least about 15 milliseconds and preferably at least about 30 milliseconds. Obviously, there is no upper limit to this residence time and it depends strictly upon the point of attachment of the burner to the heat utilization means and/or the construction of the heat utilization means.

The term "air" is employed generically herein and in the claims is meant to include air and other combustion supporting gases containing oxygen.

While the invention has been described above in terms of using a gas or liquid supplemental fuels, it is within the scope of the present invention to use any vaporous or gaseous fuel, including prevaporized liquid fuels. It is also within the scope of the present invention to use finely divided solid fuels, for example, powdered coal as well as liquids and gases derived from such solid fuels.

The term "gaseous state", as utilized herein, is meant to include normally gaseous materials, normally liquid materials in their vapor state and vapors of normally solid materials as well as fine droplets of liquid and finely divided solids suspended in gases or vapors or combinations thereof.

While specific materials, specific modes of operation and specific equipment have been referred to herein, it is to be understood that these specifics are for illustrative purposes and to set forth the best mode of operation of the present invention and are not to be considered limiting.

That which is claimed:

1. A method of recovering heat values from a vitiated gaseous mixture, other than products of the present method, containing significant amounts of at least one of oxygen and combustibles together with inert diluents, comprising:

(a) burning a supplemental fuel, in a first burning step in a first combustion zone, in the presence of a first volume of air in an amount less than the stoichiometric amount necessary for combustion of all of said supplemental fuel to produce combustion products containing unburned and partially burned supplemental fuel;

(b) mixing said vitiated gaseous mixture and a second volume of air with said combustion products of said first burning step adjacent the downstream end of said first combustion zone;

(c) said second volume of air being sufficient to produce a total amount of oxygen, including said first volume of air, oxygen, if any, present in said vitiated gaseous mixture and said second volume of air, at least equal to the stoichiometric amount necessary to burn all of said supplemental fuel and all of the combustibles, if any, present in said vitiated gaseous mixture; and (d) burning the combustibles, if any, present in said vitiated gaseous mixture, and the unburned and partially burned fuel content of said combustion products of said first burning step, in a second burning step in a second combustion zone, in the presence of said second volume of air.

2. A method in accordance with claim 1 wherein the vitiated gaseous mixture in combination with a supplemental fuel, supplemental air or both a supplemental fuel and supplemental air is incapable of stable, sustained combustion at a temperature at which said supplemental fuel is a gas or a liquid or solid in its vapor state.

3. A method in accordance with claim 1 wherein the vitiated gaseous mixture contains significant amounts of oxygen and insignificant amounts of combustibles.

4. A method in accordance with claim 1 wherein the vitiated gaseous mixture contains insignificant amounts of oxygen and significant amounts of combustibles.

5. A method in accordance with claim 1 wherein the vitiated gaseous mixture contains significant amounts of oxygen and significant amounts of combustibles.

6. A method in accordance with claim 1 wherein the first volume of air is also selected to produce a fuel-air ratio adapted to reduce $NO_x$ pollutants.

7. A method in accordance with claim 1 wherein the first volume of air is between about 35% and about 50% of the total volume of air.

8. A method in accordance with claim 1, 2, 3, 4, 5, 6 or 7 wherein the burning at the downstream end of the combustion chamber is abruptly terminated, at least in part, by mixing the vitiated gaseous mixture with the combustion products.

9. A method in accordance with claim 8 wherein the burning at the downstream end of the combustion zone is abruptly terminated by, at least in part, abruptly expanding the fluids in said combustion zone adjacent the point of introducing of the vitiated gaseous mixture.

10. A method in accordance with claim 9 wherein the vitiated gaseous mixture is introduced into the combustion products immediately before or immediately after the abrupt expansion of the fluids in the combustion zone.

11. A method in accordance with claim 9 wherein the burning at the downstream end of the combustion zone is abruptly terminated by, at least in part, reducing the peripheral dimension of the fluids in said combustion zone prior to the abrupt expansion.

12. A method in accordance with claim 11 wherein the vitiated gaseous mixture is introduced into the combustion products before the reduced peripheral dimension of the fluids in the combustion zone, into the reduced peripheral dimension portion of said fluids or after the reduction in peripheral dimension of said fluids.

13. A method in accordance with claim 12 wherein the vitiated gaseous mixture is introduced into the reduced peripheral dimension portion of the fluids.

14. A method in accordance with claims 1, 2, 3, 4, 5, 6 or 7 wherein the second combustion zone is also a heat utilization zone.

15. A method in accordance with claim 14 wherein the heat utilization zone is a furnace.

16. A method in accordance with claim 14 wherein the heat utilization zone is a boiler adapted to produce steam.

17. A method in accordance with claim 1, 2, 3, 4, 5, 6 or 7 wherein the flue gas from the second combustion zone is thereafter passed to a heat utilization zone.

18. A method in accordance with claim 17 wherein the heat utilization zone is a furnace.

19. A method in accordance with claim 17 wherein the heat utilization zone is a boiler adapted to produce steam.

20. A method in accordance with claim 1, 2, 3, 4, 5, 6 or 7 wherein the vitiated gaseous mixture is at an elevated temperature.

21. A method in accordance with claim 8 wherein the second combustion zone is also a heat utilization zone.

22. A method in accordance with claim 9 wherein the second combustion zone is also a heat utilization zone.

23. A method in accordance with claim 10 wherein the second combustion zone is also a heat utilization zone.

24. A method in accordance with claim 11 wherein the second combustion zone is also a heat utilization zone.

25. A method in accordance with claim 12 wherein the second combustion zone is also a heat utilization zone.

26. A method in accordance with claim 13 wherein the second combustion zone is also a heat utilization zone.

27. A method in accordance with claim 8 wherein the flue gas from the second combustion zone is thereafter passed to a heat utilization zone.

28. A method in accordance with claim 9 wherein the flue gas from the second combustion zone is thereafter passed to a heat utilization zone.

29. A method in accordance with claim 10 wherein the flue gas from the second combustion zone is thereafter passed to a heat utilization zone.

30. A method in accordance with claim 11 wherein the flue gas from the second combustion zone is thereafter passed to a heat utilization zone.

31. A method in accordance with claim 12 wherein the flue gas from the second combustion zone is thereafter passed to a heat utilization zone.

32. A method in accordance with claim 13 wherein the flue gas from the second combustion zone is thereafter passed to a heat utilization zone.

* * * * *